US010008210B2

(12) United States Patent
Lang et al.

(10) Patent No.: US 10,008,210 B2
(45) Date of Patent: Jun. 26, 2018

(54) METHOD, APPARATUS, AND SYSTEM FOR ENCODING AND DECODING MULTI-CHANNEL SIGNALS

(75) Inventors: Yue Lang, Munich (DE); Wenhai Wu, Beijing (CN); Lei Miao, Beijing (CN); Zexin Liu, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 1526 days.

(21) Appl. No.: 13/572,469

(22) Filed: Aug. 10, 2012

(65) Prior Publication Data

US 2012/0308017 A1 Dec. 6, 2012

Related U.S. Application Data

(63) Continuation of application No. PCT/CN2010/078440, filed on Nov. 5, 2010.

(30) Foreign Application Priority Data

Feb. 11, 2010 (CN) ..... 2010 1 0117701

(51) Int. Cl.
*H04R 5/00* (2006.01)
*G10L 19/008* (2013.01)

(52) U.S. Cl.
CPC ..... *G10L 19/008* (2013.01)

(58) Field of Classification Search
CPC ... G10L 19/0212; G10L 19/24; G10L 19/008; G10L 19/035; G10L 19/00; G10L 19/0018; G10L 19/0208; G10L 19/12; G10L 2019/0001; H03L 7/1976; H03L 7/1978; H04L 27/361; H04L 27/36; H04S 1/007; H04H 20/72; H04H 40/18
USPC ..... 381/17–23, 1; 700/94; 704/300, 500, 704/200
See application file for complete search history.

(56) References Cited

U.S. PATENT DOCUMENTS 6,240,192 B1 * 5/2001 Brennan et al. ..... 381/314
7,689,428 B2 * 3/2010 Takagi et al. ..... 704/501
8,521,540 B2 * 8/2013 Burns ..... G10L 19/035 704/200

(Continued)

FOREIGN PATENT DOCUMENTS

CN 101040323 A 9/2007
CN 101223598 A 7/2008
CN 101427307 A 5/2009

(Continued)

OTHER PUBLICATIONS

Written Opinion of the International Searching Authority dated Feb. 10, 2011 in connection with International Patent Application No. PCT/CN2010/078440, 8 pages.

(Continued)

*Primary Examiner* — Lun-See Lao

(57) ABSTRACT

A method, an apparatus, and a system for encoding and decoding multi-channel signals are disclosed. The method for encoding multi-channel signals includes: determining the category of an index corresponding to a channel level difference (CLD) which needs to be quantized in a current frame; quantizing the CLD of at least one frequency band whose index category is the same as the determined category of the index in the current frame, and obtaining quantized data.

10 Claims, 6 Drawing Sheets

(56) References Cited

U.S. PATENT DOCUMENTS

| | | | |
|---|---|---|---|
| 2008/2521510 | | 10/2008 | Jung et al. |
| 2009/0030704 | A1 | 1/2009 | Takagi et al. |

FOREIGN PATENT DOCUMENTS

| | | | | | |
|---|---|---|---|---|---|
| EP | 1 865 497 | A1 | | 12/2007 | |
| KR | 20060079119 | A | | 7/2006 | |
| WO | WO 2007/011157 | A1 | | 1/2007 | |
| WO | WO 2007/037613 | | * | 4/2007 | ..... G10I 19/00 |

OTHER PUBLICATIONS

International Search Report dated Feb. 10, 2011 in connection with International Patent Application No. PCT/CN2010/078440.

* cited by examiner

METHOD, APPARATUS, AND SYSTEM FOR ENCODING AND DECODING MULTI-CHANNEL SIGNALS

CROSS-REFERENCE TO RELATED APPLICATIONS

This application is a continuation of International Application No. PCT/CN2010/078440, filed on Nov. 5, 2010, which claims priority to Chinese Patent Application No. 201010117701.5, filed on Feb. 11, 2010, both of which are hereby incorporated by reference in their entireties.

TECHNICAL FIELD

The present invention relates to the field of audio processing technologies, and in particular, to a method, an apparatus, and a system for encoding and decoding multi-channel signals.

BACKGROUND

With the improvement of people's living standard, digital technologies are developing towards audiovisual products, and high-quality sounder products have been used by ordinary families. A multi-channel sounder has a higher quality sound effect. A channel level difference (channel level difference, CLD) is an important parameter that represents a multi-channel signal sound field, and reflects an energy relationship in each frequency band between two signals of the multi-channel signals. The CLD is widely applied in current multi-channel signal coding algorithms, for example, intensity multi-channel signal coding algorithm, parameter multi-channel signal coding algorithm, and Panning algorithm. The CLD needs to be quantized by a scalar quantizer. The scalar quantizer is a 31-dimensional vector code book $CLD_s$, where $CLD_s$=[−50, −45, −40, −35, −30, −25, −22, −19, −16, −13, −10, −8, −6, −4, −2, 0, 2, 4, 6, 8, 10, 13, 16, 19, 22, 25, 30, 35, 40, 45, 50]. The size of the code book is 5 bits. The CLDs of all frequency bands in a data frame are quantized according to the vector code book $CLD_s$, and each element in the $CLD_s$ represents the quantization level of the CLD.

During the process of implementing the present invention, the inventor discovers that the prior art has at least the following disadvantages: Because the coder needs to quantize all CLD of stereo speech signals, the complexity of quantizing the CLDs is increased, and the efficiency of quantizing the CLDs is reduced.

SUMMARY

Embodiments of the present invention provide a method, an apparatus, and a system for encoding and decoding multi-channel signals to simplify the process of quantizing CLDs and increase the efficiency of quantizing the CLDs.

An embodiment of the present invention provides a method for encoding multi-channel signals, including:

determining the category of an index corresponding to a CLD which needs to be quantized in a current frame; and quantizing the CLD of at least one frequency band whose index category is the same as the determined category of the index in the current frame, and obtaining quantized data.

An embodiment of the present invention provides an apparatus for encoding multi-channel signals, including:

a determining module, configured to determine the category of an index corresponding to a CLD which needs to be quantized in a current frame; and a quantizing module, configured to quantize the CLD of at least one frequency band whose index category is the same as the determined category of the index in the current frame, and obtain quantized data.

An embodiment of the present invention provides a method for decoding multi-channel signals, including:

receiving encoded data of a CLD in a current frame;

de-quantizing the received encoded data of the CLD in the current frame, and obtaining de-quantized data in the current frame;

obtaining, according to category information of an index corresponding to the encoded data of the CLD in the current frame, a CLD of a frequency band whose index category is different from that in the current frame in a frame previous to the current frame; and obtaining CLDs of all frequency bands in the current frame according to the de-quantized data and the CLD of the frequency band whose index category is different from that in the current frame in the frame previous to the current frame.

An embodiment of the present invention provides an apparatus for decoding multi-channel signals, including:

a receiving module, configured to receive encoded data of a CLD in a current frame;

a de-quantizing module, configured to de-quantize the received encoded data of the CLD in the current frame, and obtain de-quantized data in the current frame;

a first obtaining module, configured to obtain, according to category information of an index corresponding to the encoded data of the CLD in the current frame, a CLD of a frequency band whose index category is different from that in the current frame in a frame previous to the current frame; and a second obtaining module, configured to obtain CLDs of all frequency bands in the current frame according to the de-quantized data and the CLD of the frequency band whose index category is different from that in the current frame in the frame previous to the current frame.

An embodiment of the present invention provides a system for encoding and decoding multi-channel signals, including an apparatus for encoding multi-channel signals and an apparatus for decoding multi-channel signals, where:

the apparatus for encoding multi-channel signals is configured to: determine the category of an index corresponding to a CLD which needs to be quantized in a current frame; quantize the CLD of at least one frequency band whose index category is the same as the determined category of the index in the current frame, and obtain quantized data; and send the quantized data to the apparatus for decoding multi-channel signals; and the apparatus for decoding multi-channel signals is configured to: receive encoded data of the CLD in the current frame sent from the apparatus for encoding multi-channel signals; de-quantize the received encoded data of the CLD in the current frame, and obtain de-quantized data in the current frame; obtain, according to category information of the index corresponding to the encoded data of the CLD in the current frame, a CLD of a frequency band whose index category is different from that in the current frame in a frame previous to the current frame; and obtain CLDs of all frequency bands in the current frame according to the de-quantized data and the CLD of the frequency band whose index category is different from that in the current frame in the frame previous to the current frame.

BRIEF DESCRIPTION OF THE DRAWINGS

To make the technical solutions of the embodiments of the present invention or the prior art clearer, the following briefly describes the accompanying drawings used in the description of the embodiments or the prior art. Evidently, the accompanying drawings describe only some exemplary embodiments of the present invention and persons skilled in the art can obtain other drawings based on these drawings without creative efforts.

DETAILED DESCRIPTION

Figure 1:
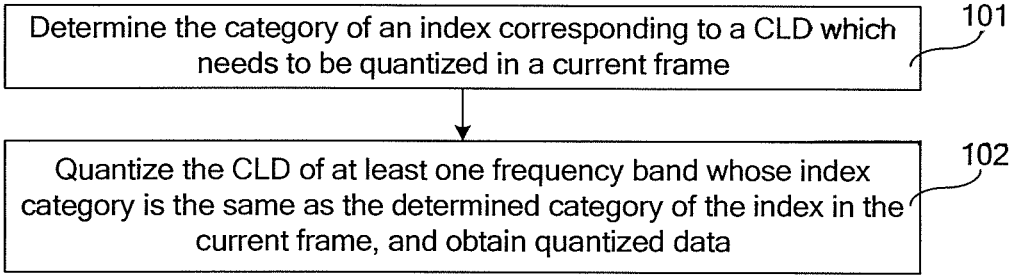
FIG. 1 is a schematic flowchart of an embodiment of a method for encoding multi-channel signals according to the present invention.

The following describes the technical solutions of the embodiments of the present invention described clearly and completely with reference to the accompanying drawings. Apparently, the described embodiments are exemplary only, without covering all embodiments of the present invention. All other embodiments that persons skilled in the art obtain based on embodiments of the present invention also fall within the protection scope of the present invention.

A channel level difference (Channel Level Difference, CLD) is a parameter that represents a sound field, and reflects an energy relationship in each frequency band between each signal in the sound field. The logarithm energy ratio in each frequency band of the CLD is $$CLD[b] = 10\log_{10}\frac{\sum_{k=k_b}^{k_{b+1}-1} X_1[k]X_1^*[k]}{\sum_{k=k_b}^{k_{b+1}-1} X_2[k]X_2^*[k]},$$

where k indicates a frequency point index, $X_1[k]$ indicates the $k^{th}$ spectrum coefficient of the first sound channel, $X_1^*[k]$ indicates the conjugation of $X_1[k]$, $X_2[k]$ indicates the $k^{th}$ spectrum coefficient of the second sound channel, $X_2^*[k]$ indicates the conjugation of $X_2[k]$, b indicates the frequency band index, and $K_b$ indicates the start frequency band index of the $b^{th}$ frequency band.

The index in embodiments of the present invention may be a frequency band number in a data frame. For example, if a data frame includes 20 frequency bands, the index may be a frequency band number: 0, 1, . . . , 19. The category of the index in embodiments of the present invention may be a group of data whose remainder is the same after the frequency numbers are divided by a specific number. For example, if the frequency numbers 0, 1, . . . , 19 are divided by 2, the remainders are 0 and 1, and in this case, there are two categories of indexes, one category with the reminders being 0 and one category with the reminders being 1. Alternately, a category of indexes with the remainders being 0 after the frequency band numbers are divided by 2 is called an even frequency band, and a category of indexes with the remainders being 1 after the indexes are divided by 2 is called an odd frequency band. Certainly, the indexes may be divided by 3, and the remainders are 0, 1, and 2, and in this case, there are three categories of indexes: a category of indexes whose remainders are 0 after the indexes are divided by 3, a category of indexes whose remainders are 1 after the indexes are divided by 3, and a category of indexes whose remainders are 2 after the indexes are divided by 3.

The category of the index in embodiments of the present invention may also be formed by grouping the frequency bands in each frame. For example, a data frame includes 20 frequency bands, and the 20 frequency bands are divided into four groups, with each group including 5 frequency bands. In this case, indexes are the group numbers 0, 1, 2, and 3, which are divided into odd groups and even groups. The odd group refers to a combination of frequency bands whose group numbers are odd numbers, and the even group refers to a combination of frequency bands whose group numbers are even numbers. For example, the combination of indexes 0 and 2 is an even group, and the combination of indexes 1 and 3 is an odd group.

FIG. 1 is a schematic flowchart of an embodiment of a method for encoding multi-channel signals according to the present invention. As shown in FIG. 1, the embodiment of the present invention includes the following steps:

Step 101: Determine the category of an index corresponding to a CLD which needs to be quantized in a current frame.

Step 102: Quantize the CLD of at least one frequency band whose index category is the same as the determined category of the index in the current frame, and obtain quantized data.

By using the method for encoding multi-channel signals according to the embodiment of the present invention, the CLDs of frequency bands whose index categories are the same in the current frame are quantized. Because the CLDs of all frequency bands in the current frame do not need to be quantized, the amount of data that needs to be quantized in the current frame is reduced, which simplifies the process of quantizing CLDs and increases the efficiency of quantizing the CLDs.

Figure 2:
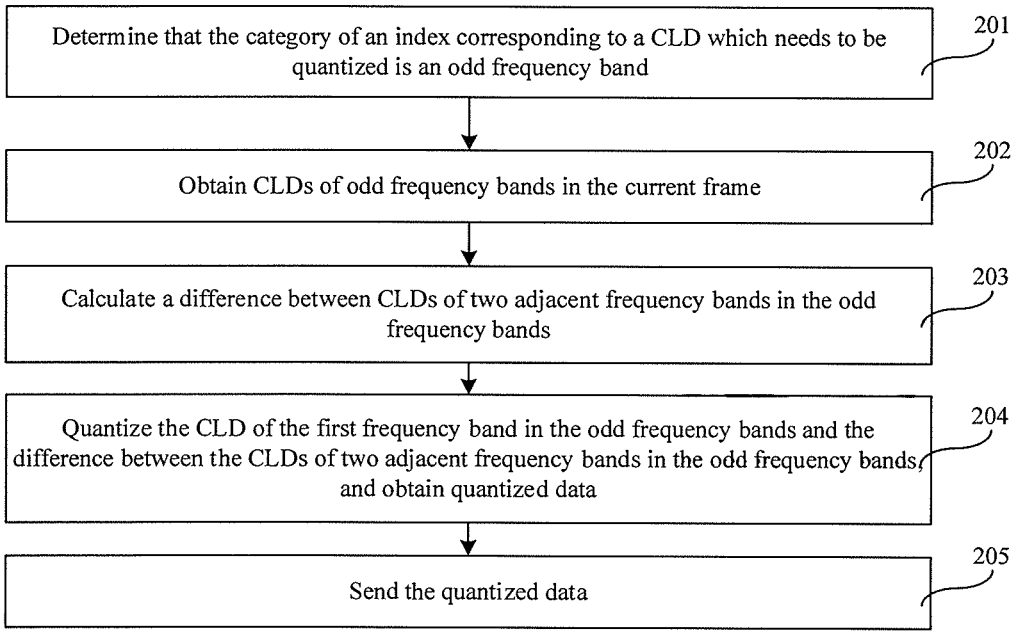
FIG. 2 is a schematic flowchart of another embodiment of a method for encoding multi-channel signals according to the present invention.

FIG. 2 is a schematic flowchart of another embodiment of a method for encoding multi-channel signals according to the present invention. This embodiment of the present invention takes the following as an example for description: only the CLDs of odd frequency bands in a current frame are processed. As shown in FIG. 2, the embodiment of the present invention includes the following steps:

Step 201: Determine that the category of an index corresponding to a CLD which needs to be quantized is an odd frequency band.

Step 202: Obtain CLDs of odd frequency bands in the current frame.

Step 203: Calculate differences between CLDs of two adjacent frequency bands in the odd frequency bands.

Step 204: Quantize the CLD of the first frequency band in the odd frequency bands and the differences between the CLDs of two adjacent frequency bands in the odd frequency bands, and obtain quantized data.

Step 205: Send the quantized data.

The quantized data includes the CLD of the first frequency band in the odd frequency bands and the differences corresponding to the CLDs of other frequency bands in the odd frequency bands in the current frame.

In the method provided in the embodiment of the present invention, the sequence of steps may be adjusted according to actual needs, and is not strictly limited.

By using the method for encoding multi-channel signals according to the embodiment of the present invention, in the case that the category of the index corresponding to the CLD which needs to be quantized is an odd frequency band, differences between the CLDs of two adjacent frequency bands in the odd frequency bands is calculated according to the CLDs of the odd frequency bands in the current frame; and the CLD of the first frequency band and the differences between the CLDs of two adjacent frequency bands in the odd frequency bands are quantized. Because the CLDs of the even frequency bands in the current frame do not need to be quantized, the amount of data that needs to be quantized in the current frame is reduced, which simplifies the process of quantizing CLDs, and further increases the efficiency of quantizing the CLDs. In addition, the CLD of the first frequency band in the odd frequency bands and the differences between the CLDs of two adjacent frequency bands in the odd frequency bands are sent. Because the CLDs of all frequency bands in the current frame do not need to be transmitted and the number of bits occupied by the difference is far smaller than those occupied by the CLD, the bit redundancy is reduced in the CLD transmission process, which increases the efficiency of data transmission.

Alternatively, the CLDs of the even frequency bands in the current frame may be processed. The specific process is as follows: Determine that the category of the index corresponding to a CLD which needs to be quantized is an even frequency band; obtain the CLDs of the even frequency bands in the current frame; calculate differences between the CLDs of two adjacent frequency bands in the even frequency bands; quantize the CLD of the first frequency band in the even frequency bands and the differences between the CLDs of two adjacent frequency bands in the even frequency bands. In the case that the category of the index corresponding to the CLD which needs to be quantized is an even frequency band, calculate differences between the CLDs of two adjacent even frequency bands in the even frequency bands according to the CLDs of the even frequency bands in the current frame, and quantize the CLD of the first frequency band in the even frequency bands and the differences between the CLDs of two adjacent even frequency bands in the even frequency bands. Because the CLDs of the odd frequency bands in the current frame do not need to be quantized, the amount of data that needs to be quantized is reduced, which simplifies process of quantizing the CLDs and further increases the efficiency of quantizing the CLDs. In addition, the quantized CLD of the first frequency band in the odd frequency bands and the differences between the CLDs of two adjacent frequency bands in the odd frequency bands are sent. Because the CLDs of all frequency bands in the current frame do not need to be transmitted and the number of bits occupied by the difference is far smaller than those occupied by the CLD, the bit redundancy is reduced in the CLD transmission process, which increases the efficiency of data transmission.

Figure 3:
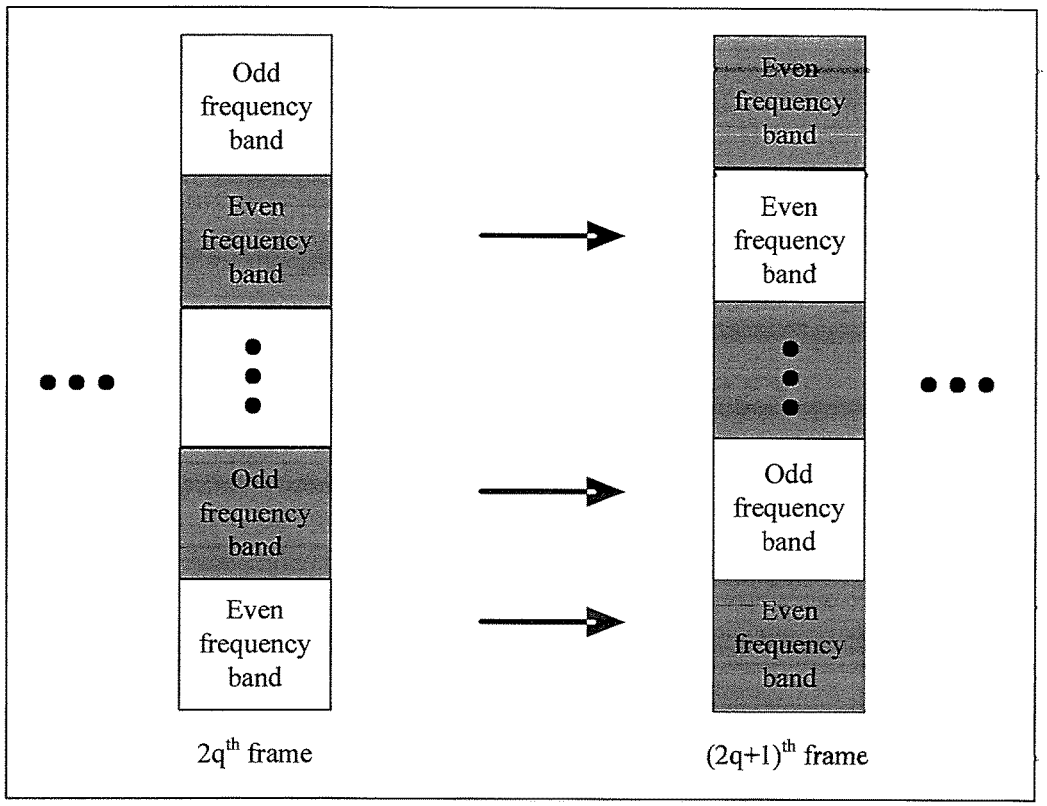
FIG. 3 is a schematic diagram of two adjacent frames in an embodiment of a method for encoding multi-channel signals according to the present invention.

To help understand the process of the method provided in the embodiment shown in FIG. 2 more clearly, the following describes the embodiment shown in FIG. 2 in detail. FIG. 3 is a schematic diagram of two adjacent frames according to the embodiment shown in FIG. 2. As shown in FIG. 3, each frame corresponding to audio signals has a total of 20 frequency bands, the indexes range from 0 to 19 and the CLDs in the odd frequency bands need to be quantized. The quantization may be performed according to the process of the method provided in the embodiment shown in FIG. 2. Specifically, if the current frame is the $2q^{th}$ frame (where q is an integer greater than or equal to 2), for the frequency bands whose indexes are (2n+1) (n is 0 and a natural number smaller than or equal to 9) in the $2q^{th}$ frame, that is, the category of the index is an odd frequency band, the index of the first frequency band in the odd frequency bands is 1. If 5 bits are used to perform scalar quantization, the quantization code book is {−50, −45, −40, −35, −30, −25, −22, −19, −16, −13, −10, −8, −6, −4, 2, 0, 2, 4, 6, 8, 10, 13, 16, 19, 22, 25, 30, 35, 40, 45, 50}. Starting from the third frequency band in the $2q^{th}$ frame, that is, the frequency band whose index is 3, the differences between the CLDs corresponding to the $(2n-1)^{th}$ frequency band and the $(2n-1)^{th}$ frequency band is calculated as follows: diff (n)=CLD (2n+1)−CLD (2n−1), where n=1, 2, . . . , 9. Because the number of bits occupied by the difference is smaller than those occupied by the CLD, a bit scale smaller than 5 may be used to perform the quantization, for example, a 4-bit scale is used to quantize the difference of the $(2m-1)^{th}$ (m is a natural number greater than or equal to 2 and smaller than or equal to 7) frequency band, and the quantization code book may be {−16, −13, −10, −8, −6, −4, −2, 0, 2, 4, 6, 8, 10, 13, 16}. The size of the quantization code book may be set according to the actual bit limitation, for example, a 3-bit scale is used to quantize the difference of the $(2k-1)^{th}$ (k is a natural number greater than or equal to 8 and smaller than or equal to 10) frequency band, and the quantization code book may be {−16, −8, −4, 0, 4, 8, 16}. According to the above process, only the CLD of the first frequency band in the odd frequency bands and the differences between the CLDs of two odd adjacent frequency bands in the odd frequency bands are sent. Because the CLDs of all frequency bands in the current band do not need to be transmitted and the number of bits occupied by the difference is far smaller than those occupied by the CLD, the bit redundancy is reduced in the CLD transmission process, which improves efficiency of data transmission.

Furthermore, if the current frame is the $(2q+1)^{th}$ frame adjacent to the $2q^{th}$ frame, the frequency band whose number is different from the category of the index of the $2q^{th}$ frame is quantized. As shown in FIG. 2, the processes of quantizing and encoding the CLDs of the even frequency bands in the $(2q+1)^{th}$ frame may refer to the above description, and are not further described.

Figure 4:
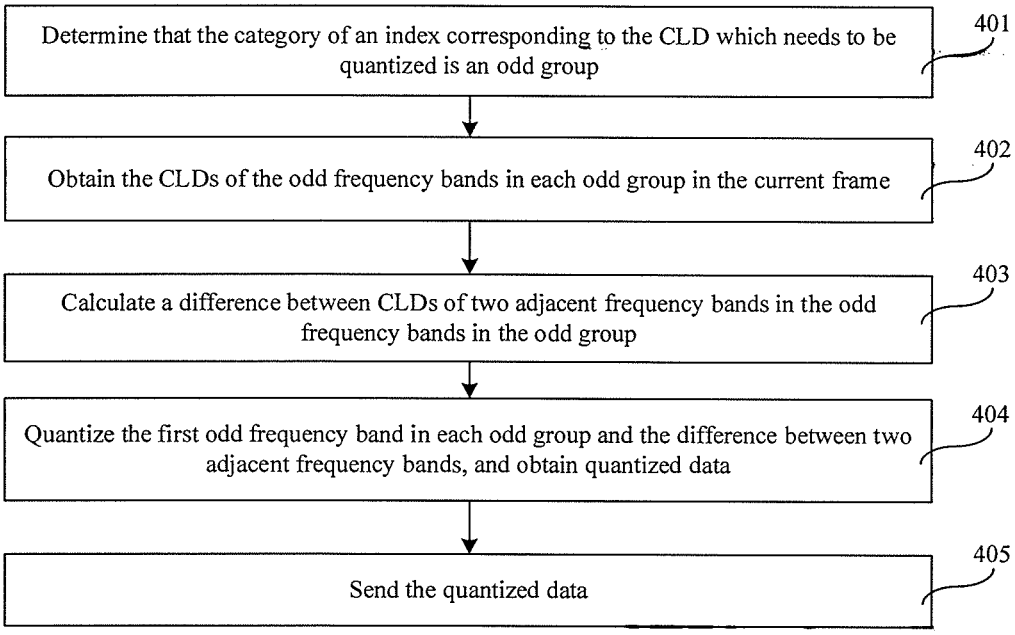
FIG. 4 is a schematic flowchart of another embodiment of a method for encoding multi-channel signals according to the present invention.

FIG. 4 is a schematic flowchart of another embodiment of a method for encoding multi-channel signals according to the present invention. This embodiment of the present invention takes the following as an example for description: only the CLDs of odd frequency bands in a current frame are processed. As shown in FIG. 4, the embodiment of the present invention includes the following steps:

Step 401: Determine that the category of an index corresponding to the CLD which needs to be quantized is an odd group.

Step 402: Obtain the CLDs of the odd frequency bands in each odd group in the current frame.

Step 403: Calculate a differences between CLDs of two adjacent frequency bands in the odd frequency bands in the odd group.

Step 404: Quantize the first odd frequency band in each odd group and the differences between two adjacent frequency bands, and obtain quantized data.

Step 405: Send the quantized data.

Specifically, the quantized data includes the CLD of the first odd frequency band in each odd group and the differences corresponding to the CLDs of other odd frequency bands in each odd group.

In the method provided in the embodiment of the present invention, the sequence of steps may be adjusted according to actual needs, and is not strictly limited.

By using the method for encoding multi-channel signals according to the embodiment of the present invention, in the case that the category of the index corresponding to a CLD which needs to be quantized is an odd group, the differences between the CLD of the first frequency band in odd frequency bands in an odd group and CLDs of other frequency bands in odd frequency bands in the odd group in the current frame is obtained and quantized. Because the CLD of the even group in the current frame does not need to be quantized, the amount of data that needs to be quantized is reduced, which increases the efficiency of quantizing the CLDs. In addition, the CLD of the first frequency band in the odd frequency bands and the differences between the CLDs of two adjacent frequency bands in the odd frequency bands are sent. Because CLDs of all frequency bands in the current frame do not need to be sent and the number of bits occupied by the difference is far smaller than those occupied by the CLD, the bit redundancy is reduced in the CLD transmission process, which increases the efficiency of data transmission.

Furthermore, the embodiment of the present invention may execute the following processes: Determine that the category of the index corresponding to a CLD which needs to be quantized is an odd group; obtain the CLDs of even frequency bands in each odd group in the current frame; calculate differences between the CLDs of two adjacent frequency bands of the even frequency bands in the odd group; quantize the CLD of the first frequency band of the even frequency bands in each odd group and the differences between two adjacent frequency bands, and obtain quantized data; and send the quantized data, where the quantized data includes the CLD of the first frequency band of the even frequency band in each odd group and the differences corresponding to the CLDs of other frequency bands of the even frequency bands in each odd group.

Furthermore, the embodiment of the present invention may execute the following processes: Determine that the category of the index corresponding to a CLD which needs to be quantized is an even group; obtain the CLDs of odd frequency bands in each even group in the current frame; calculate differences between the CLDs of two adjacent frequency bands of the odd frequency bands in the even group; quantize the CLD of the first frequency band in the odd frequency bands in each even group and the differences between two adjacent frequency bands, and obtain quantized data; and send the quantized data, where the quantized data includes the CLD of the first frequency band of the odd frequency band in each even group and the differences corresponding to the CLDs of other frequency bands of the odd frequency bands in each even group.

Alternatively, the specific process is as follows: Determine that the category of the index corresponding to a CLD which needs to be quantized is an even group; obtain the CLDs of even frequency bands in each even group in the current frame; calculate differences between the CLDs of two adjacent frequency bands of the even frequency bands in the even group; quantize the CLD of the first frequency band of the even frequency bands in each even group and the differences between two adjacent frequency bands, and obtain quantized data; and send the quantized data, where the quantized data includes the CLD of the first frequency band of the even frequency band in each even group and the differences corresponding to the CLDs of other frequency bands of the even frequency bands in each even group.

In the above process of sending a CLD, odd frequency bands or even frequency bands in the odd group in the current frame are sent or odd frequency bands or even frequency bands in the even group are sent. Because the CLDs of all frequency bands in the current frame do not need to be sent and the number of bits occupied by the difference is far smaller than those occupied by the CLD, the bit redundancy is reduced in the CLD transmission process, which increases the efficiency of data transmission.

Figure 5:
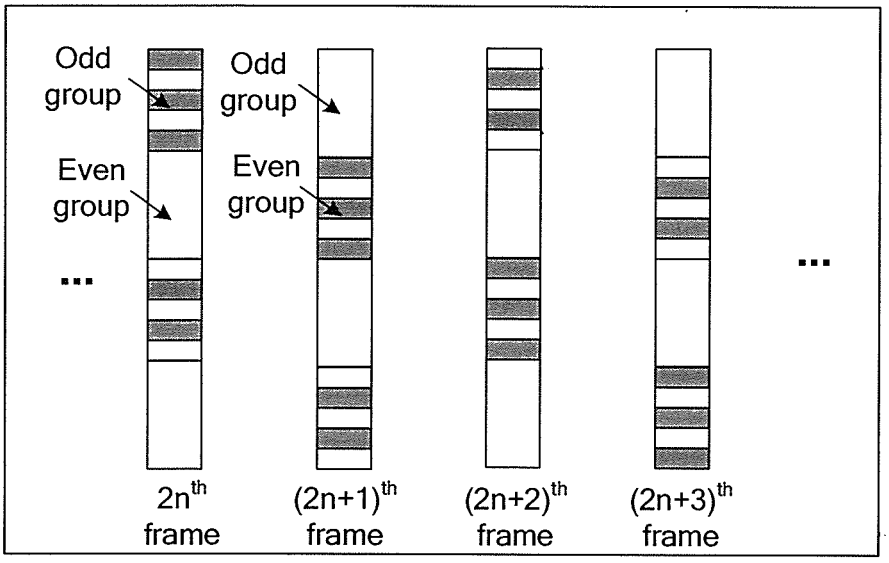
FIG. 5 is a schematic diagram of an odd group and an even group in an embodiment of a method for encoding multi-channel signals.

To help understand the process of the method provided in the embodiment shown in FIG. 4 more clearly, the following describes the embodiment shown in FIG. 4 in detail. FIG. 5 is a schematic diagram of the odd groups and the even groups shown in FIG. 4. As shown in FIG. 5, an audio signal has a total of 20 frequency bands, and CLDs in each frequency band may be calculated. The 20 frequency bands are divided into four groups: two odd groups and two even groups. Each group includes five frequency bands. The first odd group includes frequency band numbers 0, 1, 2, 3, and 4, and the second odd group includes frequency band numbers 10, 11, 12, 13, and 14. The first even group includes frequency band numbers 5, 6, 7, 8, and 9, and the second even group includes frequency band numbers 15, 16, 17, 18, and 19.

Furthermore, as shown in FIG. 5, if the current frame is a $2n^{th}$ frame, quantized data of odd frequency bands in an odd group may be sent to the decoder, quantized data of odd frequency bands in an even group is sent to the decoder at a next frame (that is, the $(2n+1)^{th}$ frame) adjacent to the $2n^{th}$ frame, quantized data of even frequency bands in an odd group is sent to the decoder at the $(2n+2)^{th}$ frame, and quantized data of even frequency bands in an even group is sent to the decoder at the $(2n+3)^{th}$ frame. The above sending mode is only an example, and different sending modes may be set according to the actual condition of the encoder. Any technical solution where the encoder sends data of some frequency bands in a data frame to the decoder according to the encoding mode provided in the embodiment of the present invention should fall within the scope of the present invention. Specifically, as shown in FIG. 5, in the case that CLDs of four successive frames are sent, the indexes sent at the $2n^{th}$ frame are group numbers (even groups) 0 and 2, and the indexes corresponding to frequency bands sent in these even groups are 0, 2, and 4; the indexes sent at the $(2n+1)^{th}$ frame are group numbers (odd groups) 1 and 3, and the indexes corresponding to frequency bands sent in these odd groups are 0, 2, and 4; the indexes sent at the $(2n+2)^{th}$ frame are group numbers (even groups) 0 and 2, and the indexes corresponding to frequency bands sent in these even groups are 1 and 3; the indexes sent at the $(2n+3)^{th}$ frame are group numbers (odd groups) 1 and 3, and the indexes corresponding to frequency bands sent in these odd groups are 1 and 3.

Further, a 5-bit scale is used to quantize the CLD of the first frequency band in odd groups in the $2n^{th}$ frame, and the quantization code book is {−50, −45, −40, −35, −30, −25, −22, −19, −16, −13, −10, −8, −6, −4, −2, 0, 2, 4, 6, 8, 10, 13, 16, 19, 22, 25, 30, 35, 40, 45, 50}. The difference diff between CLD coefficients of two adjacent frequency bands to be transmitted in odd groups is calculated. Because the number of bits occupied by the diff is smaller than those occupied by the CLD, a scale of less than five bits may be used to perform quantization. For example, a 4-bit scale may be used to perform the quantization, and the quantization code book is {−16, −13, −10, −8, −6, −4, −2, 0, 2, 4, 6, 8, 10, 13, 16}. In this case, the number of bits needed by CLDs of each frequency band to be transmitted in four successive frames is as follows: the $2n^{th}$ frame: 5, 4, 4, 5, and 4; the $(2n+1)^{th}$ frame: 5, 4, 4, 5, and 4; the $(2n+2)^{th}$ frame: 5, 4, 5, 4, and 4; the $(2n+3)^{th}$ frame: 5, 4, 5, 4, and 4. As known from the above process, data frames are grouped, and differences between the CLD of the first frequency band in a group and CLDs of other frequency bands in the group is quantized. Because the CLDs of all frequency bands in the data frame do not need to be quantized and the number of bits occupied by the difference is far smaller than those occupied by the CLD, the bit redundancy is reduced in the CLD transmission process, which increases the efficiency of data transmission.

Furthermore, if the current frame is the $(2n+1)^{th}$ frame adjacent to the $2n^{th}$ frame, the frequency band whose number is different from the category of the index of the $2n^{th}$ frame is quantized. As shown in FIG. 5, the CLDs of the odd frequency bands in the even group are quantized in the $(2n+1)^{th}$ frame. The process of quantizing the CLDs of the odd frequency bands in the even group may refer to the above description, and is not further described.

Furthermore, on the basis of the embodiments shown in FIG. 1 to FIG. 5, the category information of the indexes can also be sent, so that the decoder performs de-quantization according to the category information of the index.

Figure 6:
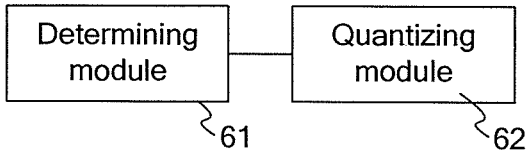
FIG. 6 is a schematic structural diagram of an embodiment of an apparatus for encoding multi-channel signals according to the present invention.

FIG. 6 is a schematic structural diagram of an embodiment of an apparatus for encoding multi-channel signals according to the present invention. As shown in FIG. 6, the embodiment includes a determining module 61 and a quantizing module 62.

The determining module 61 determines the category of an index corresponding to a CLD which needs to be quantized in a current frame. The quantizing module 62 quantizes the CLD of at least one frequency band whose index category is the same as the determined category of the index in the current frame, and obtains quantized data.

By using the apparatus for encoding multi-channel signals according to the embodiment of the present invention, the quantizing module 62 quantizes the CLDs of frequency bands whose index categories are the same as the determined category of the index in the current frame. Because the CLDs of all frequency bands in the current frame do not need to be quantized, the amount of data that needs to be quantized in the current frame is reduced, which simplifies the process of quantizing CLDs and further increases the efficiency of quantizing the CLDs.

Figure 7:
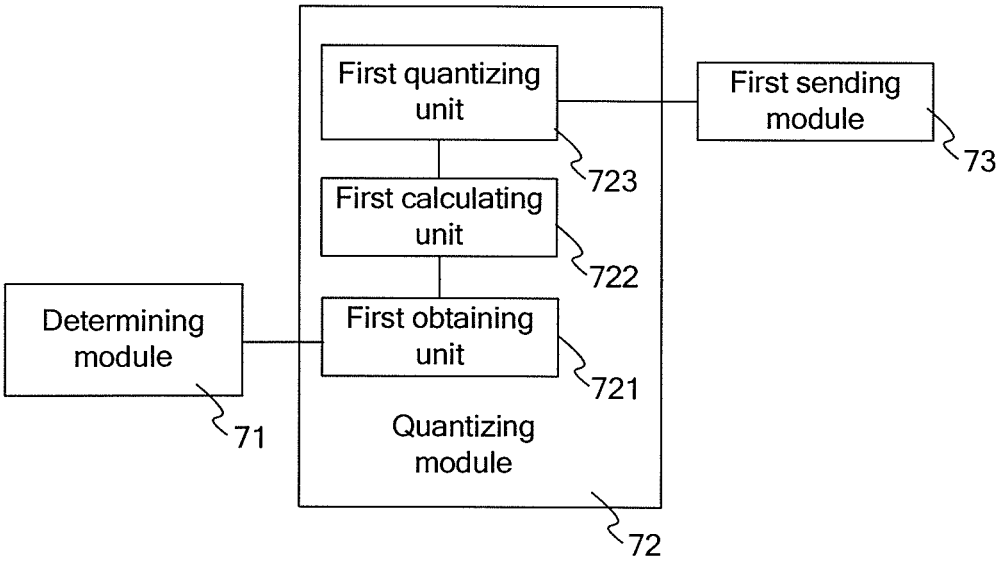
FIG. 7 is a schematic structural diagram of another embodiment of an apparatus for encoding multi-channel signals according to the present invention.

FIG. 7 is a schematic structural diagram of another embodiment of an apparatus for encoding multi-channel signals according to the present invention. As shown in FIG. 7, the embodiment includes a determining module 71, a quantizing module 72, and a first sending module 73.

The determining module 71 determines the category of an index corresponding to a CLD which needs to be quantized in a current frame. The quantizing module 72 quantizes the CLD of at least one frequency band whose index category is the same as the determined category of the index in the current frame, and obtains quantized data.

The quantizing module 72 may further include: a first obtaining unit 721, a first calculating unit 722, and a first quantizing unit 723. If the determining module 71 determines that the category of an index corresponding to a CLD which needs to be quantized is an odd frequency band, the first obtaining unit 721 obtains the CLDs of the odd frequency bands in the current frame. The first calculating unit 722 calculates differences between CLDs of two adjacent frequency bands in the odd frequency bands. The first quantizing unit 723 quantizes the CLD of the first frequency band in the odd frequency bands and the differences between CLDs of two adjacent frequency bands in the odd frequency bands, and obtains quantized data. The first sending module 73 sends the data quantized by the first quantizing unit 723, where the quantized data includes the CLD of the first frequency band in the odd frequency bands in the current frame and the differences corresponding to CLDs of other frequency bands in the odd frequency bands.

If the determining module 71 determines that the category of the index corresponding to a CLD which needs to be quantized is an even frequency band, the first obtaining unit 721 obtains the CLDs in the even frequency bands in the current frame. The first calculating unit 722 calculates the differences between CLDs of two adjacent frequency bands in the even frequency bands. The first quantizing unit 723 quantizes the CLD of the first frequency band in the even frequency bands and the differences between CLDs of two adjacent frequency bands in the even frequency bands, and obtains quantized data. The first sending module 73 sends the data quantized by the first quantizing unit 723, where the quantized data is includes the CLD of the first frequency band in the even frequency bands in the current frame and the differences corresponding to CLDs of other frequency bands in the even frequency bands.

By using the apparatus for encoding multi-channel signals according to the embodiment of the present invention, the quantizing module 72 quantizes the CLD of a frequency band whose index category is the same as the determined category of the index in the current frame. Because CLDs of all frequency bands in the current frame do not need to be quantized, the amount of data that needs to be quantized is reduced, which simplifies the process of quantizing CLDs and further increases the efficiency of quantizing the CLDs. The first sending module 73 sends CLDs of some frequency bands in the current frame. Because CLDs of all frequency bands in the current frame do not need to be transmitted and the number of bits occupied by the difference is far smaller than those occupied by the CLD, the bit redundancy is reduced in the CLD transmission process, which increases the efficiency of data transmission. Each unit provided in the embodiment of the present invention may be integrated or deployed individually. The above units may be combined into one, or split into several subunits.

Figure 8:
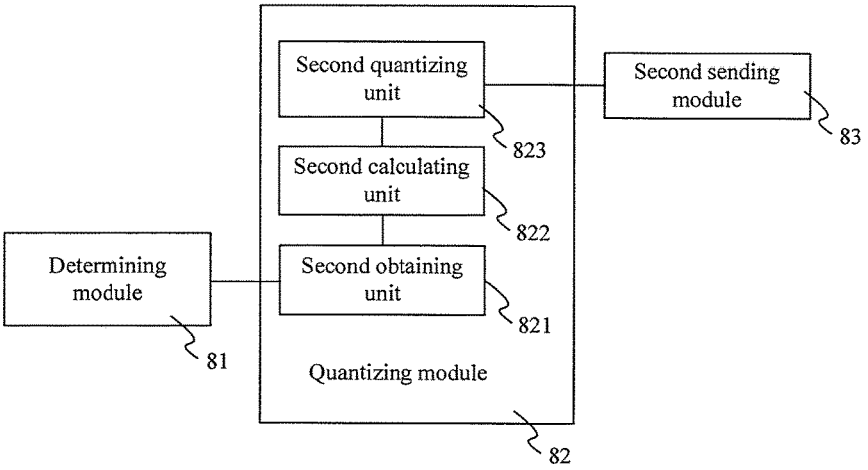
FIG. 8 is a schematic structural diagram of another embodiment of an apparatus for encoding multi-channel signals according to the present invention.

FIG. 8 is a schematic structural diagram of another embodiment of an apparatus for encoding multi-channel signals according to the present invention. As shown in FIG. 8, the embodiment includes a determining module 81, a quantizing module 82, and a second sending module 83.

The determining module 81 determines the category of an index corresponding to a CLD which needs to be quantized in a current frame. The quantizing module 82 quantizes the CLD of at least one frequency band whose index category is the same as the determined category of the index in the current frame, and obtains quantized data.

Furthermore, the quantizing module 82 may include a second obtaining unit 821, a second calculating unit 822, and a second quantizing unit 823. If the determining module 81 determines that the category of the index corresponding to the CLD which needs to be quantized is an odd group, the second obtaining unit 821 obtains the CLDs of the odd frequency bands in each odd group in the current frame. The second calculating unit 822 calculates differences between CLDs of two adjacent frequency bands in odd frequency bands in the odd group. The second quantizing unit 823 quantizes the CLDs of first frequency bands in the odd frequency bands in each odd group and the differences between two adjacent odd frequency bands, and obtains quantized data. The second sending module 83 sends the data quantized by the second quantizing unit 823, where the quantized data includes the CLDs of first frequency bands in the odd frequency bands in each odd group and the differences corresponding to CLDs of other frequency bands in the odd frequency bands in each odd group. Alternatively, the second obtaining unit 821 obtains the CLDs of even frequency bands in each odd group in the current frame. The second calculating unit 822 calculates differences between CLDs of two adjacent frequency bands in the even frequency bands in each odd group. The second quantizing unit 823 quantizes the CLDs of first frequency bands in the even frequency bands in each odd group and the differences between two adjacent even frequency bands, and obtains quantized data. The second sending module 83 sends the data quantized by the second quantizing unit 823, where the quantized data includes the CLDs of the first frequency bands in the even frequency bands in each odd group and the differences corresponding to CLDs of other frequency bands in the even frequency bands in each odd group.

If the determining module 81 determines that the category of the index corresponding to the CLD which needs to be quantized is an even group, the second obtaining unit 821 obtains the CLDs of the odd frequency bands in each even group in the current frame. The second calculating unit 822 calculates differences between CLDs of two adjacent odd frequency bands in odd frequency bands in the even group. The second quantizing unit 823 quantizes the CLDs of first frequency bands in the odd frequency bands in each even group and the differences between two adjacent frequency bands, and obtains quantized data. The second sending module 83 sends the data quantized by the second quantizing unit 823, where the quantized data is includes the CLDs of first frequency bands in the odd frequency bands in each even group and the differences corresponding to CLDs of other frequency bands in the odd frequency bands in each even group. Alternatively, the second obtaining unit 821 obtains the CLDs of even frequency bands in each even group in the current frame. The second calculating unit 822 calculates differences between CLDs of two adjacent even frequency bands in the even frequency bands in each even group. The second quantizing unit 823 quantizes the CLDs of first frequency bands in the even frequency bands in each even group and the differences between two adjacent frequency bands, and obtains quantized data. The second sending module 83 sends the data quantized by the second quantizing unit 823, where the quantized data includes the CLDs of the first frequency bands in the even frequency bands in each even group in the current frame and the differences corresponding to CLDs of other frequency bands in the even frequency bands in each even group.

By using the apparatus for encoding multi-channel signals according to the embodiment of the present invention, the quantizing module 82 quantizes the CLD of a frequency band whose index category is the same as the determined category of the index in the current frame. Because CLDs of all frequency bands in the current frame do not need to be quantized, the amount of data that needs to be quantized is reduced, which simplifies the process of quantizing CLDs and further increases the efficiency of quantizing the CLDs. The CLDs of some frequency bands in the current frame may be sent by a third sending module 84 or a fourth sending module 85. Because CLDs of all frequency bands in the current frame do not need to be transmitted and the number of bits occupied by the difference is far smaller than those occupied by the CLD, the bit redundancy is reduced in the CLD transmission process, which increases the efficiency of data transmission.

Furthermore, on the basis of the embodiments shown in FIG. 6 to FIG. 8, the apparatus may further include a fifth sending module configured to send the category information of the index, so that the receiving device performs de-quantization according to the category information of the index. Each unit provided in the embodiment of the present invention may be integrated or deployed individually. The above units may be combined into one, or split into several subunits.

Figure 9:
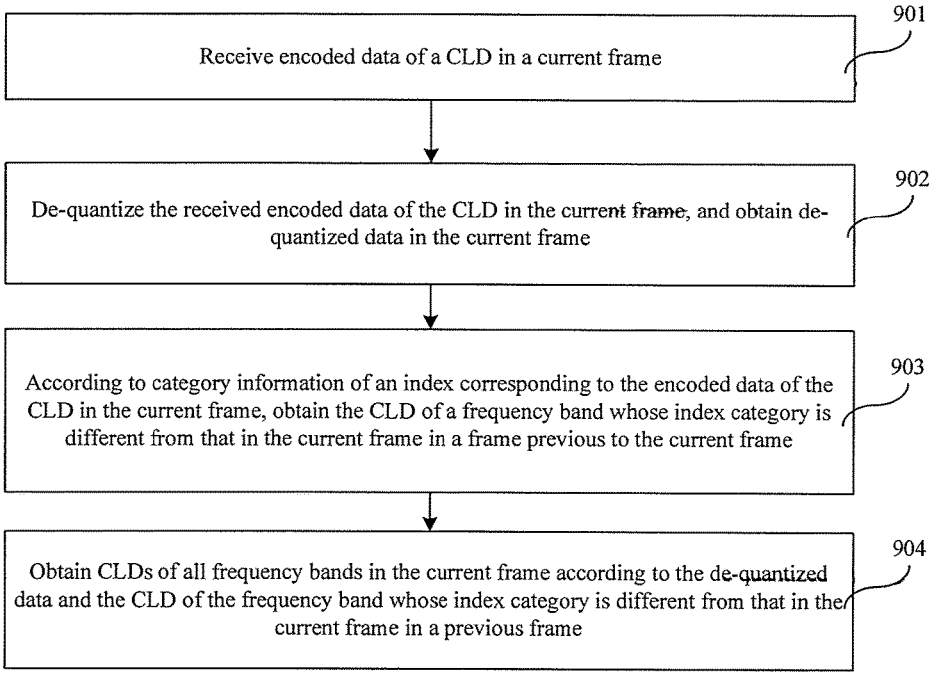
FIG. 9 is a schematic flowchart of an embodiment of a method for decoding multi-channel signals according to the present invention.

FIG. 9 is a schematic flowchart of an embodiment of a method for decoding multi-channel signals according to the present invention. As shown in FIG. 9, the embodiment of the present invention includes the following steps:

Step 901: Receive encoded data of a CLD in a current frame.

Step 902: De-quantize the received encoded data of the CLD in the current frame, and obtain de-quantized data in the current frame;

Step 903: According to category information of an index corresponding to the encoded data of the CLD in the current frame, obtain the CLD of a frequency band whose index category is different from that in the current frame in a frame previous to the current frame.

Step 904: Obtain CLDs of all frequency bands in the current frame according to the de-quantized data and the CLD of the frequency band whose index category is different from that in the current frame in the previous frame.

By using the method for decoding multi-channel signals according to the embodiment of the present invention, the CLDs of frequency bands whose index categories are the same in the current frame are de-quantized. Because the CLDs of all frequency bands in the current frame do not need to be de-quantized, the amount of data that needs to be de-quantized in the current frame is reduced, which simplifies the process of de-quantizing and further increases the efficiency of decoding and de-quantizing.

Further, if the category of the index in the current frame includes an odd frequency band and an even frequency band, step 902 further includes:

when the category information of the index in the current frame is determined to be an odd frequency band, obtaining CLDs of even frequency bands in the frame previous to the current frame; or, when the category information of the index in the current frame is determined to be an even frequency band, obtaining CLDs of odd frequency bands in the frame previous to the current frame.

If the category of the index in the current frame includes an odd group and an even group, step 902 further includes: if the category information of the index in the current frame is determined to be an odd group, obtaining the CLD of the even group in the frame previous to the current frame; or, when the category information of the index in the current frame is determined to be an even group, obtaining the CLD of the odd group in the frame previous to the current frame.

In the above process of receiving CLDs, only CLDs of the frequency bands whose index categories are the same in the current frame are received, and CLDs of all the frequency bands in each frame do not need to be received. Therefore, the bit redundancy is reduced in the CLD transmission process, which increases the efficiency of data transmission.

Further, the embodiment shown in FIG. 9 may include: if the received current frame is a first frame, obtaining a CLD of a frequency band adjacent to the received CLD according to the received CLD of the frequency band. For example, if the received first frame includes the CLD of an even frequency band, the CLD of the even frequency band is used as the CLD of an odd frequency band adjacent to the even frequency band, so that CLDs of all frequency bands in the first frame are obtained. In this way, the received first frame is not damaged in the case that the bit redundancy is reduced.

Further, the embodiment shown in FIG. 9 may include: obtaining the category information of the index corresponding to the encoded data of the CLD in the current frame, and performing de-quantization by using the category information of the index. In the method provided in the embodiment of the present invention, the sequence of steps may be adjusted according to actual needs, and is not strictly limited.

Figure 10:
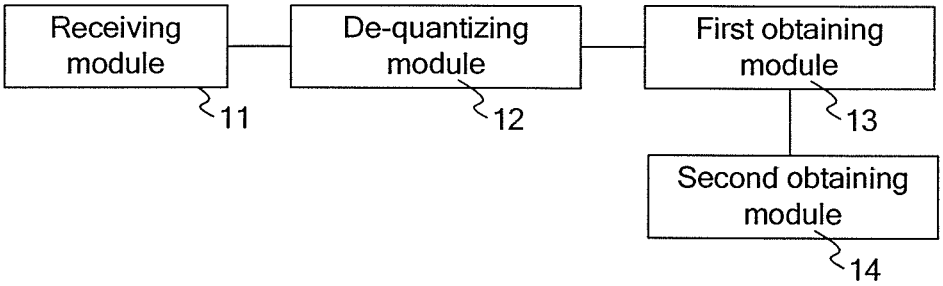
FIG. 10 is a schematic structural diagram of an embodiment of an apparatus for decoding multi-channel signals according to the present invention.

FIG. 10 is a schematic structural diagram of an embodiment of an apparatus for decoding multi-channel signals according to the present invention. As shown in FIG. 10, the embodiment includes a receiving module 11, a de-quantizing module 12, a first obtaining module 13, and a second obtaining module 14.

The receiving module 11 receives encoded data of a CLD in a current frame. The de-quantizing module 12 de-quantizes the received encoded data of the CLD in the current frame, and obtains de-quantized data of the current frame. The first obtaining module 13 obtains, according to the category information of an index corresponding to the encoded data of the CLD in the current frame, a CLD of a frequency band whose index category is different from that in the current frame in a frame previous to the current frame. The second obtaining module 14 obtains CLDs of all frequency bands in the current frame according to the de-quantized data and the CLD of the frequency band whose index category is different from that in the current frame in the frame previous to the current frame.

By using the apparatus for decoding multi-channel signals according to the embodiment of the present invention, the de-quantizing module 12 de-quantizes the received CLDs of frequency bands whose index categories are the same in the current frame. Because the CLDs of all frequency bands in the current frame do not need to be de-quantized, the amount of data that needs to be quantized in the current frame is reduced, which simplifies the de-quantization process and further improves the decoding and de-quantization efficiency. Each unit provided in the embodiment of the present invention may be integrated or deployed individually. The above units may be combined into one, or split into several subunits.

Figure 11:
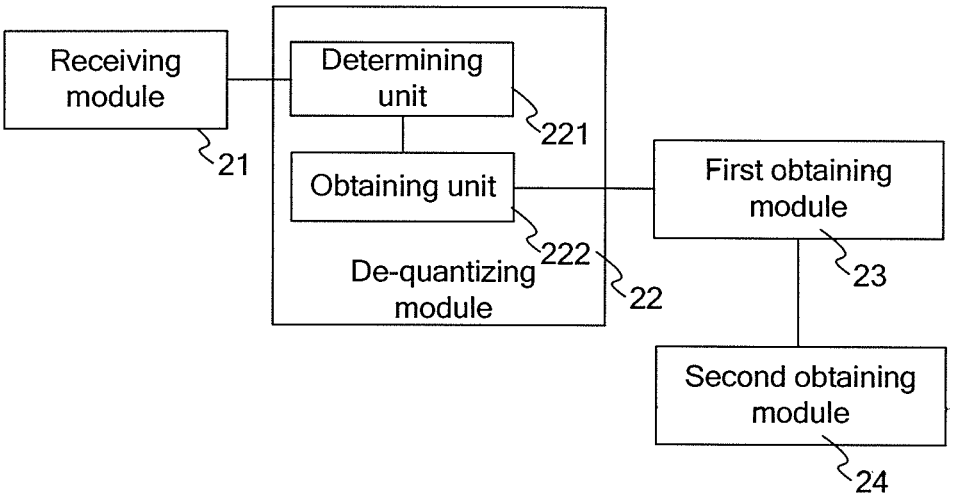
FIG. 11 is a schematic structural diagram of another embodiment of an apparatus for decoding multi-channel signals according to the present invention.

FIG. 11 is a schematic structural diagram of another embodiment of an apparatus for decoding multi-channel signals according to the present invention. As shown in FIG. 11, the embodiment includes a receiving module 21, a de-quantizing module 22, a first obtaining module 23, and a second obtaining module 24.

The receiving module 21 receives encoded data of a CLD in a current frame. The de-quantizing module 22 de-quantizes the received encoded data of the CLD in the current frame, and obtains de-quantized data of the current frame. The first obtaining module 23 obtains, according to the category information of an index corresponding to the encoded data of the CLD in the current frame, a CLD of a frequency band whose index category is different from that in the current frame in a frame previous to the current frame. The second obtaining module 24 obtains CLDs of all frequency bands in the current frame according to the de-quantized data and the CLD of the frequency band whose index category is different from that in the current frame in the frame previous to the current frame.

Furthermore, the de-quantizing module 22 may include a determining unit 221 and an obtaining unit 222. The determining unit 221 determines the category information of an index in a current frame. When the category information of the index in the current frame is determined to be an odd frequency band, the obtaining unit 222 obtains a CLD of an even frequency band in a frame previous to the current frame; or when the category information of the index in the current frame is determined to be an even frequency band, the obtaining unit 222 obtains a CLD of an odd frequency band in a frame previous to the current frame; or when the category information of the index in the current frame is determined to be an odd group, the obtaining unit 222 obtains a CLD of an even group in a frame previous to the current frame; or when the category information of the index in the current frame is determined to be an even group, the obtaining unit 222 obtains a CLD of an odd group in a frame previous to the current frame.

By using the apparatus for decoding multi-channel signals according to the embodiment of the present invention, the receiving module 12 receives only the CLDs of frequency bands whose index categories are the same in the current frame, so that the de-quantizing 22 does not need to de-quantize all the frequency bands in the current frame. Therefore, the amount of data that needs to be decoded and de-quantized in the current frame is reduced, which simplifies the de-quantization process and further increases the decoding and de-quantization efficiency.

Further, the embodiment shown in FIG. 11 may include a third obtaining module configured to: obtain the category information of the index corresponding to the encoded data of the CLD in the current frame, and perform de-quantization by using the category information of the index.

Further, the embodiment shown in FIG. 11 may include a fourth obtaining module configured to: if the received current frame is a first frame, obtain a CLD of an adjacent frequency band whose index category information is different from that corresponding to the received encoded data of the CLD of the frequency band according to the category information of the index corresponding to the received encoded data of the CLD of the frequency band. For example, if the first frame received by the receiving module includes a CLD of an even frequency band, the fourth obtaining module uses the CLD of the even frequency band as the CLD of an odd frequency band adjacent to the even frequency band, and obtains CLDs of all frequency bands in the first frame. In this manner, the received first frame is not damaged in the case that the bit redundancy is reduced.

Figure 12:
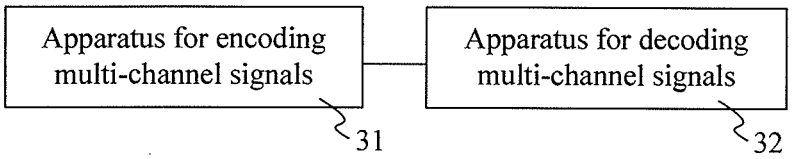
FIG. 12 is a schematic structural diagram of an embodiment of a system for encoding and decoding multi-channel signals according to the present invention.

FIG. 12 is a schematic structural diagram of an embodiment of a system for encoding and decoding multi-channel signals according to the present invention. As shown in FIG. 12, the embodiment includes an apparatus 31 for encoding multi-channel signals and an apparatus 32 for decoding multi-channel signals.

The apparatus 31 for encoding multi-channel signals is configured to: determine the category of an index corresponding to a CLD which needs to be quantized in a current frame; quantize the CLD of at least one frequency band whose index category in the current frame is the same as the determined category of the index, and obtain quantized data; and send the quantized data to the apparatus 32 for decoding multi-channel signals.

The apparatus 32 for decoding multi-channel signals is configured to: receive encoded data of the CLD in the current frame sent from the apparatus 31 for encoding multi-channel signals, de-quantize the received encoded data of the CLD in the current frame, obtain a CLD of a frequency band whose index category is different from that in the current frame in a frame previous to the current frame according to the category information of the index corresponding to the encoded data of the CLD in the current frame, and obtain CLDs of all frequency bands in the current frame.

In the system for encoding and decoding multi-channel signals according to the embodiment of the present invention, the apparatus 31 for encoding multi-channel signals quantizes a CLD of a frequency band whose index category is the same as the determined category of the index in a current frame. Because CLDs of all frequency bands in the current frame do not need to be quantized, the amount of data that needs to be quantized in the current frame is reduced, which simplifies the process of quantizing CLDs and increases the efficiency of quantizing the CLDs. In addition, the apparatus 32 for decoding multi-channel signals de-quantizes CLDs of frequency bands whose index categories are the same in the current frame. Because CLDs of all frequency bands in the current frame do not need to be de-quantized, the amount of data that needs to be de-quantized in the current frame is reduced, which simplifies the process of de-quantizing the CLDs and increases the efficiency of de-quantizing the CLDs. Because only CLDs of some frequency bands in the current frame are transmitted between the apparatus 31 for encoding multi-channel signals and the apparatus 32 for decoding multi-channel signals, CLDs of all frequency bands in the current frame do not need to be transmitted. Therefore, the bit redundancy is reduced in the CLD transmission process, which increases the efficiency of data transmission. Each unit provided in the embodiment of the present invention may be integrated or deployed individually. The above units may be combined into one, or split into several subunits.

To make the technical effect of embodiments of the present invention clearer, signal to noise ratios (Signal to Noise Ratio, SNR) of nine music type files are tested in the process of transmitting data frames. The test results are shown in Table 1.

TABLE 1

| | File No. | | | | | | | | |
|---|---|---|---|---|---|---|---|---|---|
| | 1 | 2 | 3 | 4 | 5 | 6 | 7 | 8 | 9 |
| Prior Art | 9.3 | 12.36 | 9.97 | 13.67 | 12.37 | 6.33 | 6.42 | 9.22 | 9.73 |
| Present Invention | 9.12 | 11.84 | 9.61 | 13.38 | 12.3 | 6.19 | 6.27 | 9.07 | 9.7 |

According to Table 1, the bit redundancy is reduced in the transmission process in embodiments of the present invention in the case that the SNR in embodiments of the present invention is slightly smaller than that in the prior art.

The embodiments of the present invention can be applicable to the processing of dual-channel stereo parameters and multi-channel stereo parameters, for example, 5.1 channel, 7.1 channel, and 10.2 channel. Of course, embodiments of the present invention are not limited by the number of stereo channels. All processes of quantizing and encoding channel parameters by referring to the technical solution provided in embodiments of the present invention fall within the scope of the present invention.

It is understandable to those skilled in the art that the specific working processes of the preceding system, apparatuses, modules, and units may refer to corresponding processes provided in the method embodiment of the present invention and are not further described.

It is understandable to persons skilled in the art that all or some of the processes in the preceding methods of embodiments may be implemented by related hardware instructed by a computer program. The program may be stored in a computer readable storage medium. When the program is executed, the processes of the preceding methods are executed. The preceding storage medium may be a magnetic disk, a CD-ROM, a read-only memory (Read-Only Memory, ROM), or a random access memory (Random Access Memory, RAM).

Detailed above are only several embodiments of the present invention, and those skilled in the art can make variations or modifications to the present invention without departing from the spirit and scope of the present invention. It is understandable to persons skilled in the art that the exemplary embodiments or features of different embodiments can be combined into new embodiments without conflicts.

What is claimed is:

1. A method for encoding multi-channel signals, the method comprising:

determining a category of an index corresponding to a channel level difference which needs to be quantized in a current frame of the multi-channel signals, wherein the category of the index is only one of odd frequency bands and even frequency bands, or the category of the index is only one of an odd group and an even group;

quantizing a channel level difference of at least one frequency band whose index category is the same as the determined category of the index in the current frame, to obtain quantized data; and sending the quantized data.

2. The method according to claim 1, wherein:

determining the category of the index corresponding to the channel level difference which needs to be quantized in the current frame comprises:

determining that the category of the index corresponding to the channel level difference which needs to be quantized in the current frame is odd frequency bands; and quantizing the channel level difference of at least one frequency band whose index category is the same as the determined category of the index in the current frame and obtaining the quantized data comprises:

obtaining channel level differences of the odd frequency bands in the current frame;

calculating a difference between channel level differences of two adjacent frequency bands in the odd frequency bands; and quantizing a channel level difference of a first frequency band in the odd frequency bands and the difference between the channel level differences of two adjacent frequency bands in the odd frequency bands, and obtaining quantized data.

3. The method according to claim 1, wherein:

determining the category of the index corresponding to the channel level difference which needs to be quantized in the current frame comprises:

determining that the category of the index corresponding to the channel level difference which needs to be quantized in the current frame is even frequency bands; and quantizing the channel level difference of at least one frequency band whose index category is the same as the determined category of the index in the current frame and obtaining the quantized data comprises:

obtaining channel level differences of the even frequency bands in the current frame;

calculating a difference between the channel level differences of two adjacent frequency bands in the even frequency bands; and quantizing a channel level difference of a first frequency band in the even frequency bands and the difference between the channel level differences of two adjacent frequency bands in the even frequency bands, and obtaining quantized data.

4. The method according to claim 1, wherein:

determining the category of the index corresponding to the channel level difference which needs to be quantized in the current frame comprises:

determining that the category of the index corresponding to the channel level difference which needs to be quantized in the current frame is an odd group; and quantizing the channel level difference of at least one frequency band whose index category is the same as the determined category of the index in the current frame and obtaining the quantized data comprises:

obtaining channel level differences of odd frequency bands in the odd group in the current frame;

calculating a difference between channel level differences of two adjacent frequency bands of the odd frequency bands in the odd group; and quantizing a channel level difference of a first frequency band of the odd frequency bands in the odd group and the difference between channel level differences of two adjacent frequency bands, and obtaining quantized data; or, obtaining channel level differences of even frequency bands in the odd group in the current frame;

calculating a difference between channel level differences of two adjacent frequency bands of the even frequency bands in the odd group; and quantizing a channel level difference of a first frequency band of the even frequency bands in the odd group and the difference between channel level differences of two adjacent frequency bands, and obtaining quantized data.

5. The method according to claim 1, wherein:

determining the category of the index corresponding to the channel level difference which needs to be quantized in the current frame comprises:

determining that the category of the index corresponding to the channel level difference which needs to be quantized in the current frame is an even group; and quantizing the channel level difference of at least one frequency band whose index category is the same as the determined category of the index in the current frame and obtaining the quantized data comprises:

obtaining channel level differences of odd frequency bands in the even group in the current frame;

calculating a difference between channel level differences of two adjacent frequency bands in the odd frequency bands in the even group; and quantizing a channel level difference of a first frequency band of the odd frequency bands in the even group and the difference between channel level differences of two adjacent frequency bands, and obtaining quantized data; or, obtaining channel level differences of even frequency bands in the even group in the current frame;

calculating a difference between channel level differences of two adjacent frequency bands in the even frequency bands in the even group; and quantizing a channel level difference of a first frequency band of the even frequency bands in the even group and the difference between channel level differences of two adjacent frequency bands, and obtaining quantized data.

6. The method according to claim 1, further comprising:

sending information about the category of the index to a decoder, so that the decoder performs decoding according to the category information of the index.

7. An apparatus for encoding multi-channel signals, the apparatus comprising:

a determining module, configured to determine a category of an index corresponding to a channel level difference which needs to be quantized in a current frame of the multi-channel signals, wherein the category of the index is only one of odd frequency bands and even frequency bands, or the category of the index is only one of an odd group and an even group;

a quantizing module, configured to quantize a channel level difference of at least one frequency band whose index category is the same as the determined category of the index in the current frame, to obtain quantized data; and a sending module, configured to send the quantized data.

8. An apparatus for encoding multi-channel signals, the apparatus comprising:

a determining module, configured to determine a category of an index corresponding to a channel level difference which needs to be quantized in a current frame; and a quantizing module, configured to quantize a channel level difference of at least one frequency band whose index category is the same as the determined category of the index in the current frame, to obtain quantized data;

wherein the quantizing module comprises a first obtaining unit, a first calculating unit, and a first quantizing unit, wherein:

if the determining module determines that the category of the index corresponding to the channel level difference which needs to be quantized in the current frame is an odd frequency band, the first obtaining unit is configured to obtain channel level differences of the odd frequency bands in the current frame;

the first calculating unit is configured to calculate a differences between channel level differences of two adjacent frequency bands in the odd frequency bands; and the first quantizing unit is configured to quantize a channel level difference of a first frequency band in the odd frequency bands and the differences between the channel level differences of two adjacent frequency bands in the odd frequency bands, and obtain quantized data;

if the determining module determines that the category of the index corresponding to the channel level difference which needs to be quantized is an even frequency band, the first obtaining unit is configured to obtain channel level differences of the even frequency bands in the current frame;

the first calculating unit is configured to calculate a differences between channel level differences of two adjacent frequency bands in the even frequency bands; and the first quantizing unit is configured to quantize a channel level difference of a first frequency band in the even frequency bands and the differences between the channel level differences of two adjacent frequency bands in the even frequency bands, and obtain quantized data.

9. An apparatus for encoding multi-channel signals, the apparatus comprising:

a determining module, configured to determine a category of an index corresponding to a channel level difference which needs to be quantized in a current frame of the multi-channel signals; and a quantizing module, configured to quantize a channel level difference of at least one frequency band whose index category is the same as the determined category of the index in the current frame, to obtain quantized data;

wherein the quantizing module comprises a second obtaining unit, a second calculating unit, and a second quantizing unit, wherein:

if the determining module determines that the category of the index corresponding to the channel level difference which needs to be quantized in the current frame is an odd group, the second obtaining unit is configured to obtain channel level differences of odd frequency bands in the odd group in the current frame;

the second calculating unit is configured to calculate a differences between channel level differences of two adjacent frequency bands in the odd frequency bands in the odd group; and the second quantizing unit is configured to quantize a channel level difference of a first frequency band of the odd frequency bands in the odd group and the differences between two adjacent odd frequency bands, and obtain quantized data; or, the second obtaining unit is configured to obtain channel level differences of even frequency bands in the odd group in the current frame;

the second calculating unit is configured to calculate differences between channel level differences of two adjacent frequency bands in the even frequency bands in the odd group; and the second quantizing unit is configured to quantize a channel level difference of a first frequency band of the even frequency bands in the odd group and the differences between two adjacent even frequency bands, and obtain quantized data;

if the determining module determines that the category of the index corresponding to the channel level difference which needs to be quantized in the current frame is an even group, the second obtaining unit is configured to obtain channel level differences of odd frequency bands in the even group in the current frame;

the second calculating unit is configured to calculate differences between channel level differences of two adjacent odd frequency bands in the odd frequency bands in the even group; and the second quantizing unit is configured to quantize a channel level difference of a first frequency band of the odd frequency bands in the even group and the difference between channel level differences of two adjacent frequency bands, and obtain quantized data; or, the second obtaining unit is configured to obtain channel level differences of even frequency bands in the even group in the current frame;

the second calculating unit is configured to calculate a difference between channel level differences of two adjacent even frequency bands in the even frequency bands in the even group; and the second quantizing unit is configured to quantize a channel level difference of a first frequency band of the even frequency bands in the even group and the difference between channel level differences of two adjacent frequency bands, and obtain quantized data.

10. The apparatus according to claim 7, wherein the sending module is further configured to send information about the category of the index to a decoder, so that the decoder performs decoding according to the category information of the index.

* * * * *